United States Patent [19]

Hamada et al.

[11] Patent Number: 5,002,408

[45] Date of Patent: Mar. 26, 1991

[54] APPARATUS AND METHOD FOR PRINTING CHARACTER AND RULED LINE

[75] Inventors: Akira Hamada, Osaka; Yasuji Obuchi, Nara; Hideo Miyoshi, Nara; Hirokatsu Akiyama, Nara, all of Japan

[73] Assignee: Sharp Kabushiki Kaisha, Osaka, Japan

[21] Appl. No.: 404,608

[22] Filed: Sep. 8, 1989

[30] Foreign Application Priority Data

Sep. 9, 1988 [JP] Japan ..... 63-226869

[51] Int. Cl.[5] ..... B41J 29/26

[52] U.S. Cl. ..... 400/17; 364/520; 340/730

[58] Field of Search ..... 400/17, 18, 12, 63, 400/64, 65, 279; 364/519, 520; 340/722, 730, 731

[56] References Cited

U.S. PATENT DOCUMENTS

| | | | |
|---|---|---|---|
| 4,480,316 | 10/1984 | Yano et al. | 400/17 |
| 4,488,827 | 12/1984 | Hagenuma | 400/17 |
| 4,500,216 | 2/1985 | Demonte et al. | 400/63 |
| 4,615,012 | 9/1986 | Arazu et al. | 364/520 |
| 4,733,248 | 3/1988 | Hibino | 364/520 |
| 4,734,707 | 3/1988 | Sasaki | 364/520 |
| 4,837,709 | 6/1989 | Sasaki | 364/519 |
| 4,906,114 | 3/1990 | Tanaka et al. | 340/734 |

*Primary Examiner*—Eugene H. Eickholt

[57] ABSTRACT

An apparatus for printing characters and ruled lines which includes an input device for inputting character data and lateral and longitudinal line data, a printing device for printing characters and ruled lines every page on prescribed paper, and a control device for judging whether a longitudinal line exists or not in each of the lines just before and after the boundary between two pages and giving any one of the following instructions to the printing device when the existence of a lateral line is recognized on the boundary; (i) to print a lateral line on the bottom of the foot line of the previous page when the longitudinal line exists on the last line before the boundary but not on the first line after the boundary; (ii) to print a lateral line on the upside of the first line of the following page when the longitudinal line exists on the first line after the boundary but not on the first line before the boundary; and (iii) to print a lateral line on the bottom of the foot line of the previous page and the upside of the first line of the following page when the longitudinal line exists on both of the lines just before and after the boundary, and a method of printing characters and ruled lines.

5 Claims, 4 Drawing Sheets

| BOUNDARY BETWEEN PAGES | LAST LINE BEFORE BOUNDARY | FIRST LINE AFTER BOUNDARY |
|---|---|---|
| n − 2 • n − 1 | 0 | 0 |
| n − 1 • n | 1 | 1 |
| n • n + 1 | 1 | 0 |
| n + 1 • n + 2 | 0 | 1 |

6

APPARATUS AND METHOD FOR PRINTING CHARACTER AND RULED LINE

BACKGROUND OF THE INVENTION

1. Field of the Invention

The present invention relates to an apparatus for printing characters and ruled lines and a method of printing the same and, more specifically, it relates to an electronic apparatus, such as a word processor and a personal computer, of which printing unit prints inputted characters and ruled lines and a method of printing characters and ruled lines including lateral and longitudinal lines.

2. Description of the Prior Art

In a conventional word processor, for example, a lateral line inputted on the boundary between pages is ruled on the upside of the first line (row of characters) after the boundary, i.e., the upside of the first line of the second page, in printing. This will be fully apparent from FIGS. 5 and 6. FIG. 5 illustrates inputted list information outputted on a display screen. Herein, a lateral line is inputted on the page boundary between two listed elements "electronic notepad" and "electronic translating machine". In printing the list elements of FIG. 5 in a printing unit, after the elements are printed to the boundary between two pages, the previous page is turned to the following page and the lateral line inputted on the boundary is ruled only on the upside of the first line of the following new page, as shown in FIG. 6.

In the conventional line printing apparatus stated above, when a lateral line is inputted on the bottom of the line just before the boundary between two pages, i.e., the foot line of the previous page or the bottom of the last line before the boundary in listing, there arises no problem with display on the screen but not with printing; that is, the lateral line on the bottom of the foot line of the previous page is not ruled in printing, and hence the lateral line must be manually ruled in position after the printing. However, it is time consuming work and besides the manually finished line is apt to be uneven, and therefore the last line before the boundary between the pages is often intentionally left blank to make an open block for the list. In such a case, however, when the list is modified for adding a new item or deleting an existing item from the list, or changing a line space, a line or lines of inputted information elements slides up or down or the page contains an increased or decreased number of lines, so that the blank line positioned in the last line before the boundary of the pages slides up or down and a line of information elements enters the last line before the boundary. Accordingly, it is necessary to regulate the position of the blank line each time the blank line slides. If a number of modifications and changes of the list are required, the input operation efficiency in listing worsens all the more.

The prior art embodiments related to such a printing apparatus and a printing method are disclosed in Japanese Patent Publication Nos. 153443/1981, 117281/1981, 22287/1982 and 65885/1984.

SUMMARY OF THE INVENTION

The present invention provides an apparatus for printing characters and ruled lines which incudes input means for inputting character data, ruled line data including lateral and longitudinal line data and various instructions; first storage means for storing the character data inputted by the input means; second storage means for storing the lateral and longitudinal line data inputted by the input means; printing means for printing characters and ruled lines every page on prescribed paper; control means for judging whether a longitudinal line exists or not in each of the lines just before and after the boundary between two pages and giving an instruction to the printing means to print the character and the ruled line read from the storage means according to a print instruction from the input means; and third storage means for storing the existence of the longitudinal line in each of the lines just before and after the boundary; the control means reading the existence of the longitudinal line from the third storage means and giving any one of the following instructions to the printing means when the existence of a lateral line is recognized on the boundary; (i) to print a lateral line on the bottom of the foot line of the previous page when the longitudinal line exists on the last line before the boundary but not on the first line after the boundary; (ii) to print a lateral line on the upside of the first line of the following page when the longitudinal line exists on the first line after the boundary but not on the first line before the boundary; and (iii) to print a lateral line on the bottom of the foot line of the previous page and the upside of the first line of the following page when the longitudinal line exists on both of the lines just before and after the boundary, and a method of printing characters and ruled lines.

As the input means, a keyboard is preferably used, and a pointing device such as a tablet input device or a mouse may be also used. As to the control means, a CPU, a ROM and a RAM are preferably provided and, further desirably, a program for inputting characters and lines and a table buffer are provided. As each of the storage means, a dedicated RAM can be used, or the storage means may share a RAM with the control means if the control means includes it. As the printing means, a laser printer, a dot impact type printer, a thermal type printer, an ink jet printer or the like can be used. Preferably, the third storage means stores as 2 bit data the existence of a longitudinal line in the lines just before and after the boundary between two pages. Alternatively, the third storage means may store data individually about a longitudinal line in the line just before the boundary and that in the line just after the boundary. The apparatus usually includes a display device such as a CRT, an LCD and an EL display, and presents characters, lines and boundary between pages on a display screen. The apparatus can be applied to a word processor, a personal computer and the like.

According to the present invention, in the case that a lateral line has been inputted on the boundary between pages, the lateral line is, in printing, positioned and ruled depending upon whether a longitudinal line exists or not in each of the lines just before and after the boundary, so that there is no need for manually ruling the lateral line if the foot line of a page is used for an entry of a list item.

DESCRIPTION OF THE PREFERRED EMBODIMENTS

A printing apparatus and method according to the present invention will now be described in an example of a word processor.

Figures 1, 2:
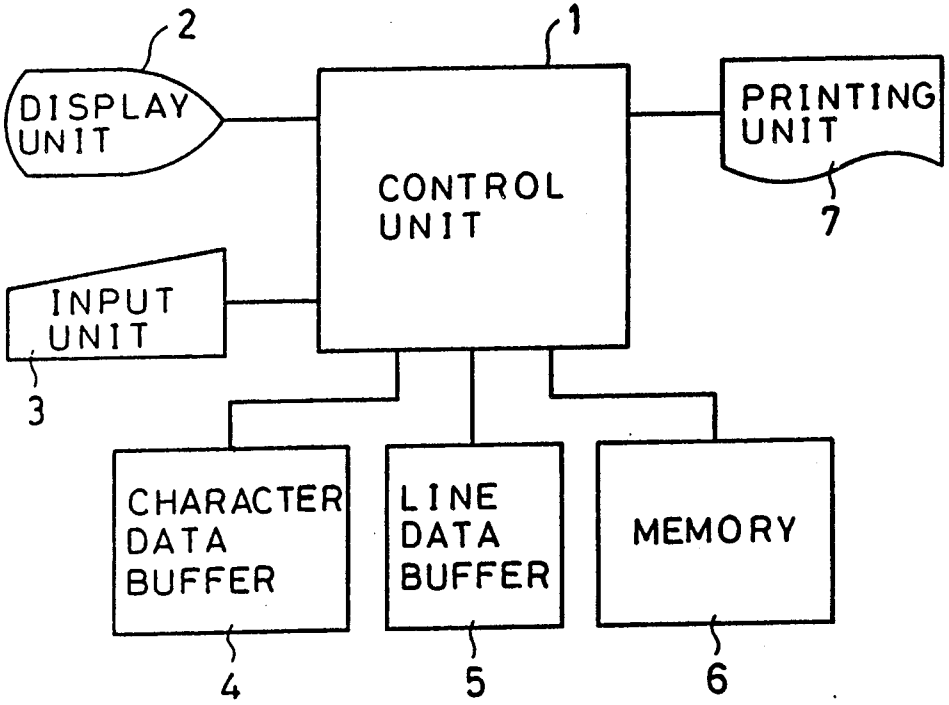
FIG. 1 is a diagram illustrating an architecture of a word processor to which the present invention is applied.
FIG. 2 is a diagram illustrating a system architecture of a memory for storing the existence of a longitudinal line in each of the lines just before and after the boundary of pages.

FIG. 1 is a block diagram showing an architecture of a word processor. A control unit 1 includes ROMs having a program for inputting characters and ruled lines, RAMs having a table buffer area, a CPU and the like. A display unit 2 incudes a CRT, an LCD or the like. An input unit 3 includes a keyboard or the like. A character data buffer 4 stores character data inputted, and a line data buffer 5 stores ruled line data inputted. A memory 6 stores the existence of a longitudinal line in each of the lines just before and after the boundary between pages. The RAM of the control unit 1 can be used instead of the memory 6. Reference numeral 7 denotes a printing unit.

Then, the function of the present invention with the aforementioned system will be described.

Character data inputted from the input unit 3 is stored in the character data buffer 4. Meanwhile, ruled line data inputted from the input unit 3 is stored in the line data buffer 5. The ruled line data stored in the line data buffer 5 represents which line (row of characters) and which column in a page an inputted ruled line is attached to. The display unit 2 presents on a screen a combination of characters and ruled lines based on data in the character data buffer 4 and that in the line data buffer 5, so that an operator can recognize the positional relation between characters and ruled lines. Which line or successive lines each of the longitudinal lines lies across can be found from data in the line data buffer 5. Further, the RAM of the control unit 1 or the character data buffer 4 stores a predetermined size of a sheet of paper, pitch of line feed, character number in one line and code for each of page alteration and line feed. The number of lines in one page can be found from the data in the RAM of the character data buffer 4, and therefore which line is the last line before the boundary between pages and which line is the first line after the page boundary can also be found. Accordingly, the control unit 1 judges whether a longitudinal line exists or not in each of the lines just before and after each page boundary, and the memory 6 stores the result.

FIG. 2 shows a system architecture of the memory 6. The memory allocates 2 bits to each of page boundaries to store the existence of a longitudinal line in each of the lines just before and after the boundary. An example given in FIG. 2 will be explained as follows. As to the boundary between page (n−2) and page (n−1), a longitudinal line does not exist on either of the lines just before and after the boundary. As to the boundary between page (n−1) and page (n), a longitudinal line exists on both of the lines just before and after the boundary. As to the boundary between page (n) and page (n+1), a longitudinal line exists on the last line before the boundary, or the foot line of the page (n). As to the boundary between page (n+1) and page (n+2), a longitudinal line exists on the first line after the boundary, or the first line of the page (n+2).

Now, the operation in printing will be described.

When an instruction to print is given from the input unit 3, the control unit 1 supplies data in the character data buffer 4 and data in the line data buffer 5 to the printing unit 7, so that characters and ruled lines are printed.

Figure 3:
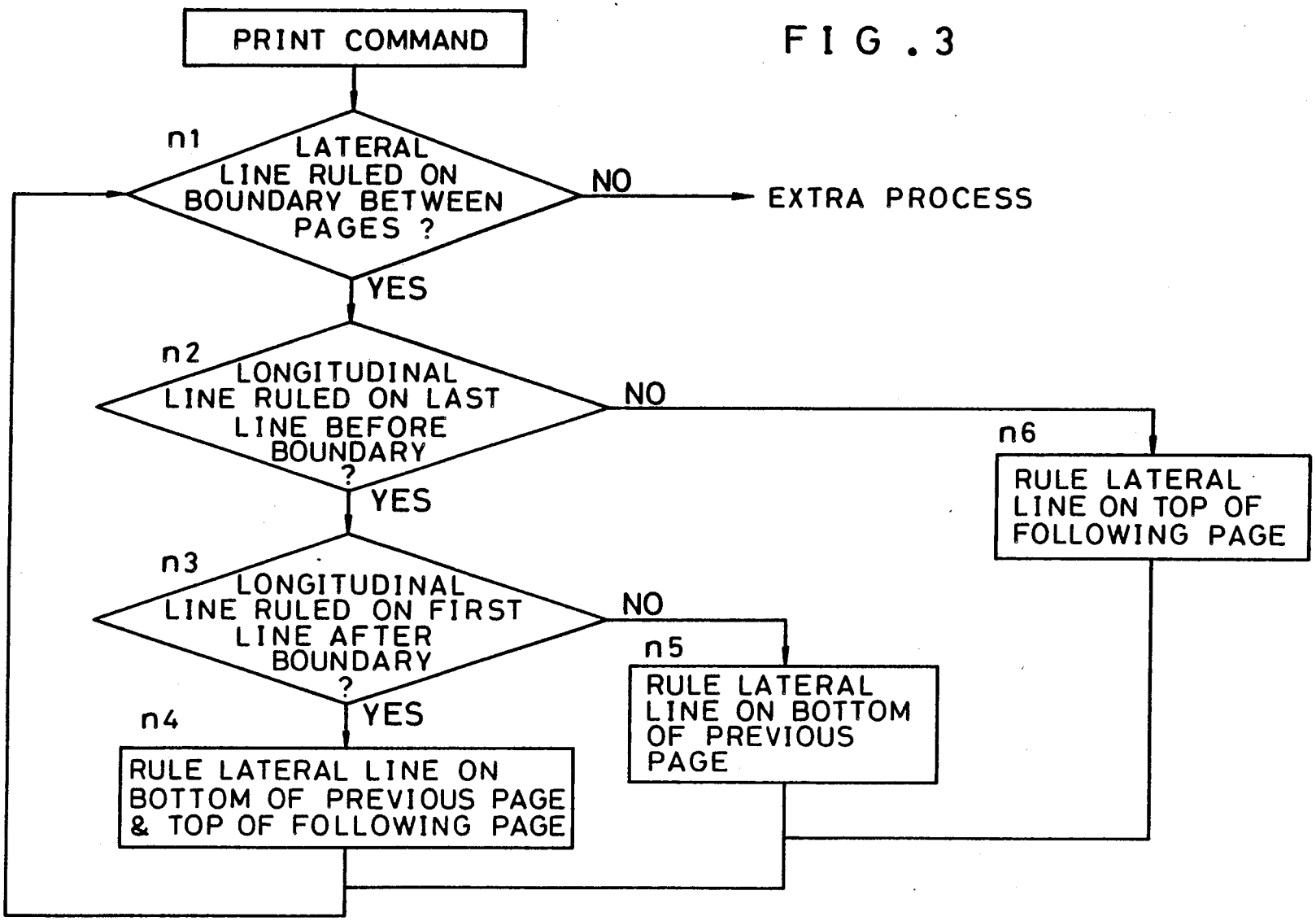
FIG. 3 is a flow chart showing the printing operation in the case that a lateral line has been inputted on the boundary of pages.

Now, the process of the control unit 1 in the case that a longitudinal line exists on the boundary between pages will be explained with reference to the flow chart of FIG. 3. When an input of a lateral line on the boundary between two pages is recognized at step n1, it is confirmed with data in the memory 6 whether a longitudinal line exists or not in the lines just before and after the boundary (steps n2 and n3). When the longitudinal line exists on both of the lines just before and after the boundary, a lateral line is ruled on the bottom of the foot line of the previous page and the upside of the first line of the following page at step 4.

When the longitudinal line exists only on the last line before the boundary, the lateral line is ruled on the bottom of the foot line of the previous page at step n5.

When the longitudinal line exists only on the first line after the boundary and the longitudinal line does not exist on either of the last line before the boundary and the first line after the boundary, the lateral line is ruled on the upside of the first line of the following page at step n6.

Figures 4A, 4B, 4C:
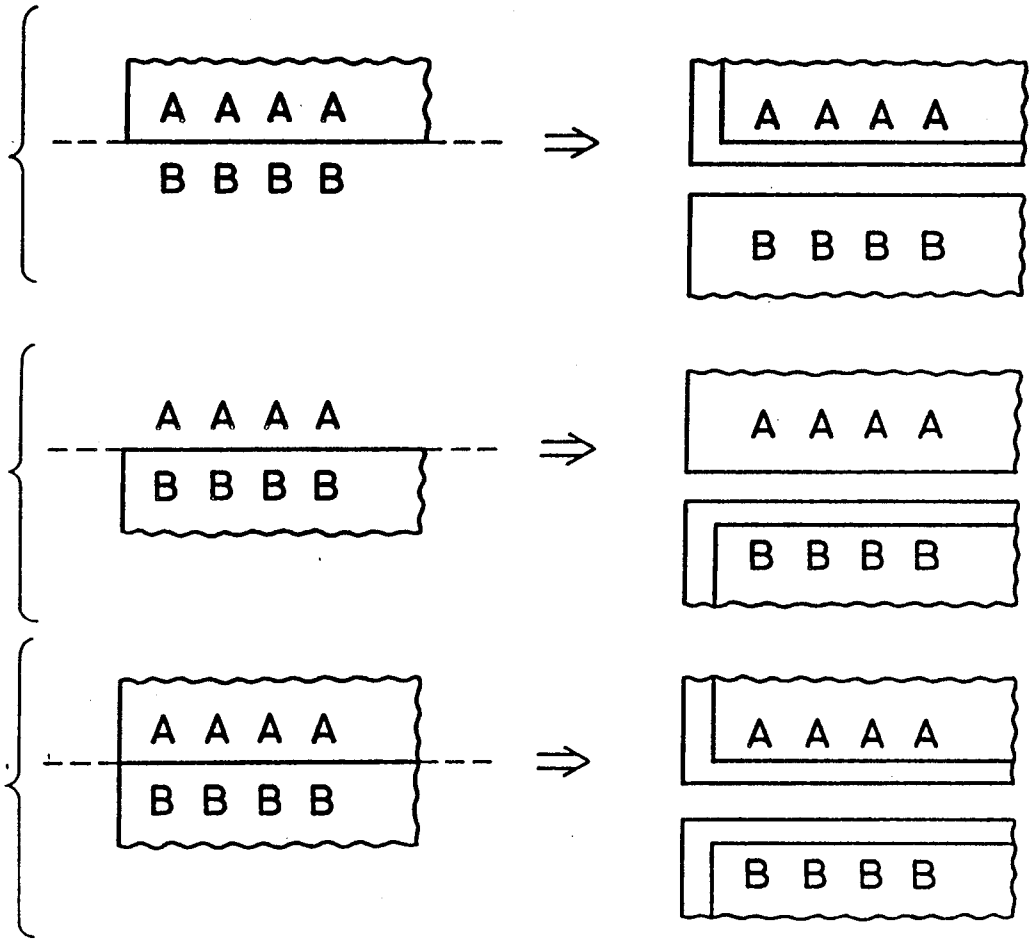
FIG. 4 is a diagram illustrating a state of the printing in the case that the lateral line has been inputted on the boundary.
Figure 5:
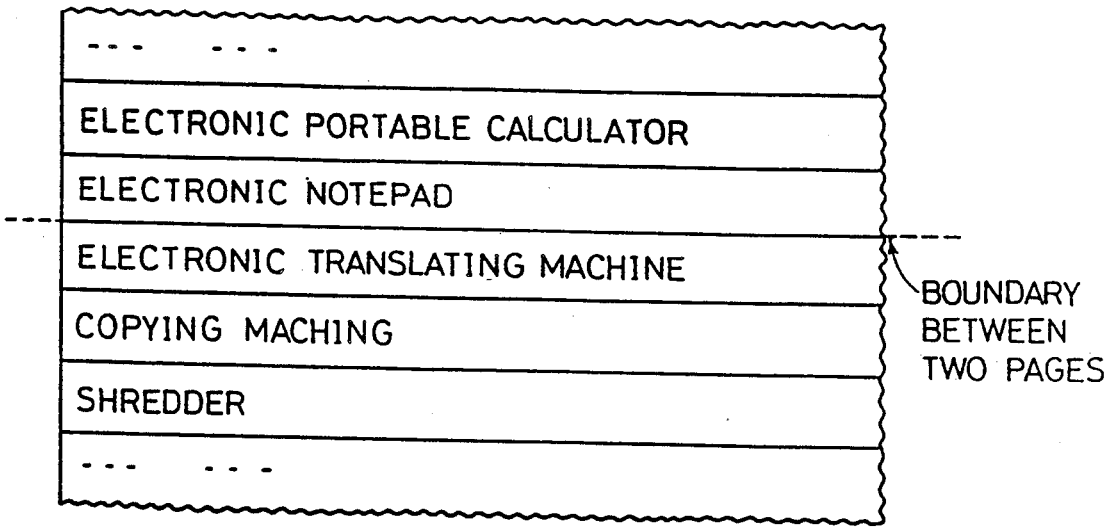
FIG. 5 (PRIOR ART)
FIGS. 5 and 6 are diagrams illustrating the lateral line on the boundary in a state on a display screen and a state of the printing according to a prior art embodiment.
Figure 6:
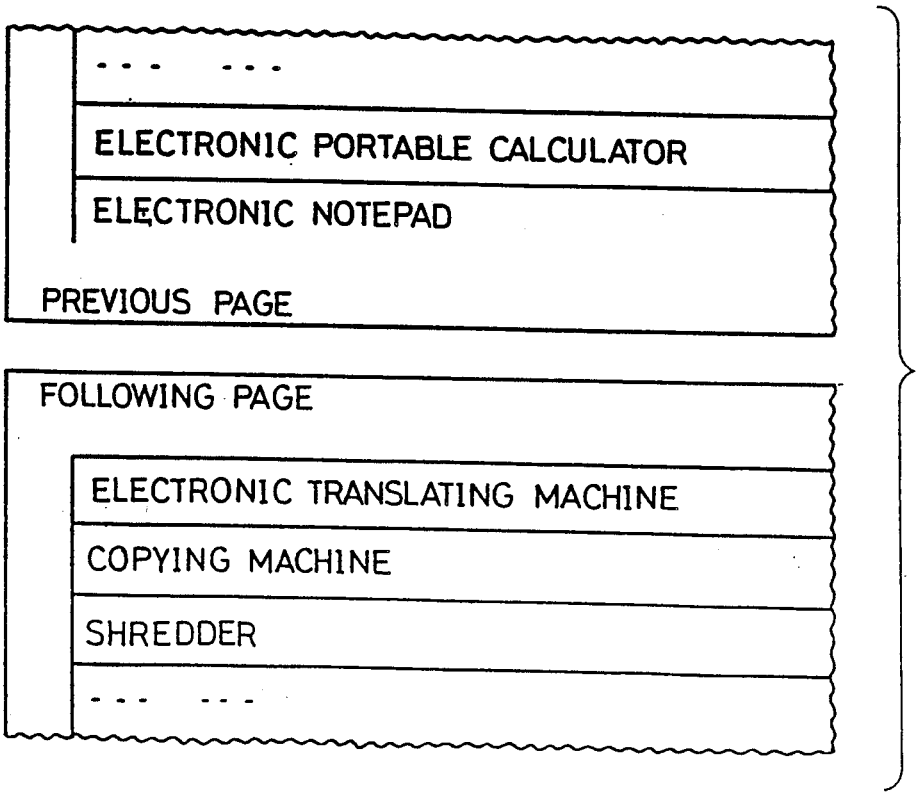
FIG. 6 (PRIOR ART)

An example of the printing in the aforementioned case that a lateral line exists on the boundary between pages is shown in FIG. 4 in comparison with the display on a screen of the display unit 2.

(A), (B) and (C) in FIG. 4 show cases as follows:

(A) a longitudinal line exists on the last line before the boundary;

(B) a longitudinal line exists on the first line after the boundary; and (C) a longitudinal line exists on both of the lines before and after the boundary.

The display on the screen of the display unit 2 is shown on the left in (A), (B) and (C), where a broken line represents the boundary of the pages. A practical printing of the display on the left is shown on the right.

As has been described, according to the present invention, in the case that a lateral line has been inputted on the boundary between pages, the lateral line is, in printing, positioned and ruled depending upon whether a longitudinal line exists or not in each of the lines just before and after the boundary, so that there is no need for manually ruling a lateral line if the foot line of a page is used for an entry of a list item.

Accordingly, even in the case of making a list of a large number many names, addition and deletion of an item can be performed without taking notion of the existence of the page boundary, so that the input operation efficiency is significantly improved in listing.

What is claimed is:

1. A character and ruled line printing apparatus comprising:

input means for inputting character data, ruled line data including lateral and longitudinal line data and various instructions;

first storage means for storing the character data inputted by the input means;

second storage means for storing the lateral and longitudinal line data inputted by the input means;

printing means for printing characters and ruled lines every page on prescribed paper;

control means for judging whether a longitudinal line exists or not in each of the lines just before and after the boundary between two pages and giving an instruction to the printing means to print the character and the ruled line read from the storage means according to a print instruction from the input means; and third storage means for storing the existence of the longitudinal line in each of the lines just before and after the boundary;

the control means reading the existence of the longitudinal line from the third storage means and giving any one of the following instructions to the printing means when the existence of a lateral line is recognized on the boundary;

(i) to print a lateral line on the bottom of the foot line of the previous page when the longitudinal line exists on the last line before the boundary but not on the first line after the boundary;

(ii) to print a lateral line on the upside of the first line of the following page when the longitudinal line exists on the first line after the boundary but not on the first line before the boundary; and (iii) to print a lateral line on the bottom of the foot line of the previous page and the upside of the first line of the following page when the longitudinal line exists on both of the lines just before and after the boundary.

2. An apparatus according to claim 1, in which the third storage means stores as 2-bit data the existence of the longitudinal line in each of the lines just before and after the boundary between pages.

3. An apparatus according to claim 1, further comprising display means for displaying the character, the line and the boundary between two pages.

4. An apparatus according to claim 1 which is a word processor.

5. A character and ruled line printing method comprising the steps of judging whether a longitudinal line exists or not in each of the lines just before and after the boundary between two pages, when the existence of a lateral line is recognized on the boundary;

(i) printing a lateral line on the bottom of the foot line of the previous page when the longitudinal line exists on the last line before the boundary but not on the first line after the boundary;

(ii) printing a lateral line on the upside of the first line of the following page when the longitudinal line exists on the first line after the boundary but not on the last line before the boundary; and (iii) printing a lateral line on the bottom of the foot line of the previous page and the upside of the first line of the following page when the longitudinal line exists on both of the lines just before and after the boundary.

* * * * *